US009778672B1

(12) United States Patent
Gao et al.

(10) Patent No.: US 9,778,672 B1
(45) Date of Patent: Oct. 3, 2017

(54) GATE BOOSTED LOW DROP REGULATOR

(71) Applicant: QUALCOMM Incorporated, San Diego, CA (US)

(72) Inventors: Zhuo Gao, Cary, NC (US); Bupesh Pandita, Raleigh, NC (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 15/086,956

(22) Filed: Mar. 31, 2016

(51) Int. Cl.
*G05F 1/575* (2006.01)

(52) U.S. Cl.
CPC ..... *G05F 1/575* (2013.01)

(58) Field of Classification Search
CPC .... H02M 3/156–3/158; H02M 3/1584; H02M 3/1588; G05F 1/56; G05F 1/565; G05F 1/573; G05F 1/575; Y02B 70/1466
USPC ..... 323/271–285
See application file for complete search history.

(56) References Cited

U.S. PATENT DOCUMENTS 5,631,598 A * 5/1997 Miranda ..... G05F 1/565 327/483
6,188,212 B1 * 2/2001 Larson ..... G05F 1/56 323/274
6,617,832 B1 * 9/2003 Kobayashi ..... H02M 3/07 323/266
8,248,150 B2 8/2012 Tadeparthy et al.
9,223,329 B2 * 12/2015 Pulvirenti ..... G05F 1/56
2010/0327959 A1 12/2010 Lee
2011/0089916 A1 4/2011 Soenen et al.
2014/0084896 A1 3/2014 Zhang et al.
2015/0198959 A1 7/2015 Kuttner
2015/0198960 A1 7/2015 Zhang et al.

FOREIGN PATENT DOCUMENTS

WO WO-2014042726 A1 3/2014

OTHER PUBLICATIONS

Alon E., et al., "Replica Compensated Linear Regulators for Supply-Regulated Phase-Locked Loops," IEEE Journal of Solid-State Circuits, vol. 41, No. 2, Feb. 2006, pp. 413-424.
Bontempo G., et al., "Low Supply Voltage, Low Quiescent Current, ULDO Linear Regulator," The 8th IEEE International Conference on Electronics, Circuits and Systems 2001, pp. 409-412.
(Continued)

*Primary Examiner* — Yemane Mehari
(74) *Attorney, Agent, or Firm* — Loza & Loza, LLP/Qualcomm

(57) ABSTRACT

In certain aspects, a voltage regulator includes a pass transistor having a drain coupled to an input of the voltage regulator, a source coupled to an output of the voltage regulator, and a gate. The voltage regulator also includes an amplifier having a first input coupled to a reference voltage, a second input coupled to a feedback voltage, and an output, wherein the feedback voltage is approximately equal to or proportional to a voltage at the output of the voltage regulator. The voltage regulator further includes a voltage booster having an input coupled to the output of the amplifier and an output coupled to the gate of the pass transistor, wherein the voltage booster is configured to boost a voltage at the input of the voltage booster to generate a boosted voltage, and to output the boosted voltage at the output of the voltage booster.

16 Claims, 9 Drawing Sheets

(56) References Cited

OTHER PUBLICATIONS

Bulzacchelli J.F., et al., "Dual-Loop System of Distributed Microregulators With High DC Accuracy, Load Response Time Below 500 ps, and 85-mV Dropout Voltage," IEEE Journal of Solid-State Circuits, vol. 47, No. 4, Apr. 2012, pp. 863-874.
Camacho D., et al., "An NMOS Low Dropout Voltage Regulator with Switched Floating Capacitor Gate Overdrive," Department of Electrical Engineering, Southern Methodist University, Dallas, Texas, USA, 52nd IEEE International Midwest Symposium on Circuits and Systems, Aug. 2009, pp. 808-811.
Den Besten G.W., et al., "Embedded 5 V-to-3.3 V Voltage Regulator for Supplying Digital IC's in 3.3 V CMOS Technology," IEEE Journal of Solid-State Circuits, vol. 33, No. 7, Jul. 1998, pp. 956-962.
Gupta V., et al., "A Low Dropout, CMOS Regulator with High PSR over Wideband Frequencies", IEEE International Symposium on Circuits and Systems, May 2005, pp. 4245-4248.
International Search Report and Written Opinion—PCT/US2017/022195—ISA/EPO—May 26, 2017.

* cited by examiner

GATE BOOSTED LOW DROP REGULATOR

BACKGROUND

Field

Aspects of the present disclosure relate generally to voltage regulators, and more particularly, to low dropout (LDO) regulators.

Background

Voltage regulators are used in a variety of systems to provide regulated voltages to power circuits in the systems. A commonly used voltage regulator is a low dropout (LDO) regulator. An LDO regulator may be used to provide a clean regulated voltage to power a circuit from a noisy input supply voltage. An LDO regulator typically includes a pass element and an error amplifier coupled in a feedback loop to maintain an approximately constant output voltage based on a stable reference voltage.

SUMMARY

The following presents a simplified summary of one or more embodiments in order to provide a basic understanding of such embodiments. This summary is not an extensive overview of all contemplated embodiments, and is intended to neither identify key or critical elements of all embodiments nor delineate the scope of any or all embodiments. Its sole purpose is to present some concepts of one or more embodiments in a simplified form as a prelude to the more detailed description that is presented later.

According to an aspect, a voltage regulator is provided. The voltage regulator includes a pass transistor having a drain coupled to an input of the voltage regulator, a source coupled to an output of the voltage regulator, and a gate. The voltage regulator also includes an amplifier having a first input coupled to a reference voltage, a second input coupled to a feedback voltage, and an output, wherein the feedback voltage is approximately equal to or proportional to a voltage at the output of the voltage regulator. The voltage regulator further includes a voltage booster having an input coupled to the output of the amplifier and an output coupled to the gate of the pass transistor, wherein the voltage booster is configured to boost a voltage at the input of the voltage booster to generate a boosted voltage, and to output the boosted voltage at the output of the voltage booster.

A second aspect relates to a method for voltage regulation. The method includes inputting a reference voltage to a first input of an amplifier, and inputting a feedback voltage to a second input of the amplifier, wherein the feedback voltage is approximately equal to or proportional to a voltage at an output of a voltage regulator. The method also includes boosting a voltage at an output of the amplifier to obtain a boosted voltage, and outputting the boosted voltage to a gate of a pass transistor, wherein a drain of the pass transistor is coupled to an input of the voltage regulator and a source of the voltage regulator is coupled to the output of the voltage regulator.

A third aspect relates to an apparatus for voltage regulation. The apparatus includes means for generating a voltage based on a difference between a reference voltage and a feedback voltage, wherein the feedback voltage is approximately equal to or proportional to a voltage at an output of the apparatus. The apparatus also includes means for boosting the generated voltage to obtain a boosted voltage, and means for adjusting a resistance of a pass element in response to the boosted voltage in order to maintain an approximately regulated voltage at the output of the apparatus.

To the accomplishment of the foregoing and related ends, the one or more embodiments include the features hereinafter fully described and particularly pointed out in the claims. The following description and the annexed drawings set forth in detail certain illustrative aspects of the one or more embodiments. These aspects are indicative, however, of but a few of the various ways in which the principles of various embodiments may be employed and the described embodiments are intended to include all such aspects and their equivalents.

DETAILED DESCRIPTION

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. However, it will be apparent to those skilled in the art that these concepts may be practiced without these specific details. In some instances, well-known structures and components are shown in block diagram form in order to avoid obscuring such concepts.

Figure 1:
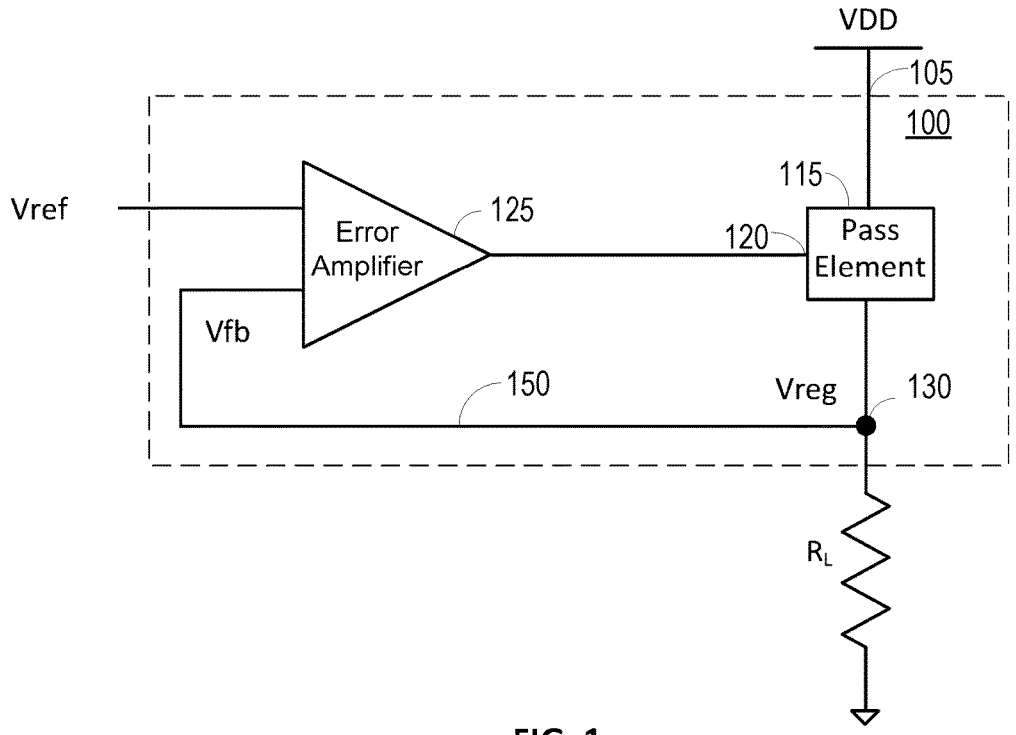
FIG. 1 shows an example of a low dropout (LDO) regulator.

FIG. 1 shows an example of a low dropout (LDO) regulator 100 according to certain aspects of the present disclosure. The LDO regulator 100 may be used to provide a noise-sensitive circuit (not shown) with a clean regulated voltage to power the circuit from a noisy input supply voltage. The noisy input supply voltage may come from a switching regulator used to down convert a voltage of a battery to the input supply voltage or may come from another voltage source.

The LDO regulator 100 includes a pass element 115 and an error amplifier 125. The pass element 115 is coupled between the input 105 and the output 130 of the LDO regulator 100. The input 105 of the LDO regulator 100 may be coupled to a power supply rail having a supply voltage of VDD. The regulated voltage (denoted "Vreg") at the output 130 of the LDO regulator 100 is approximately equal to VDD minus the voltage drop across the pass element 115. The pass element 115 includes a control input 120 for controlling the resistance of the pass element 115 between the input 105 and the output 130 of the LDO regulator 100. In FIG. 1, the resistor $R_L$ represents the resistive load of a circuit (not shown) coupled to the output of the LDO regulator 100.

The output of the error amplifier 125 is coupled to the control input 120 of the pass element 115 to control the resistance of the pass element 115. By controlling the resistance of the pass element 115, the error amplifier 125 is able to control the voltage drop across the pass element 115, and hence the regulated voltage Vreg at the output 130 of the LDO regulator 100. As discussed further below, the error amplifier 125 adjusts the resistance of the pass element 115 based on feedback of the regulated voltage Vreg to maintain the regulated voltage Vreg at approximately a desired voltage.

As shown in FIG. 1, the regulated voltage Vreg at the output 130 of the LDO regulator 100 is fed back to the error amplifier 125 via a feedback path 150 to provide the error amplifier 125 with a feedback voltage (denoted "Vfb"). In this example, the feedback voltage Vfb is approximately equal to the regulated voltage Vreg since the regulated voltage Vreg is fed directly to the error amplifier 125 in this example. A reference voltage (denoted "Vref") is also input to the error amplifier 125. The reference voltage Vref may come from a bandgap circuit (not shown) or another stable voltage source.

During operation, the error amplifier 125 drives the control input 120 of the pass element 115 in a direction that reduces the difference (error) between the reference voltage Vref and the feedback voltage Vfb input to the error amplifier 125. Since the feedback voltage Vfb is approximately equal to the regulated voltage Vreg in this example, the error amplifier 125 drives the control input 120 of the pass element 120 in a direction that causes the regulated voltage Vreg to be approximately equal to the reference voltage Vref. For example, if the regulated voltage Vreg (and hence feedback voltage Vfb) increases above the reference voltage Vref, the error amplifier 125 increases the resistance of the pass element 115, which increases the voltage drop across the pass element 115. The increased voltage drop lowers the regulated voltage Vreg at the output 130, thereby reducing the difference (error) between Vref and Vfb. If the regulated voltage Vreg falls below the reference voltage Vref, the error amplifier 125 decreases the resistance of the pass element 115, which decreases the voltage drop across the pass element 115. The decreased voltage drop raises the regulated voltage Vreg at the output 130, thereby reducing the difference (error) between Vref and Vreg. Thus, the error amplifier 125 adjusts the resistance of the pass element 115 to maintain an approximately constant regulated voltage Vreg at the output 130 based on the reference voltage Vref even when the power supply varies (e.g., due to noise) and/or the current load changes.

Figure 2:
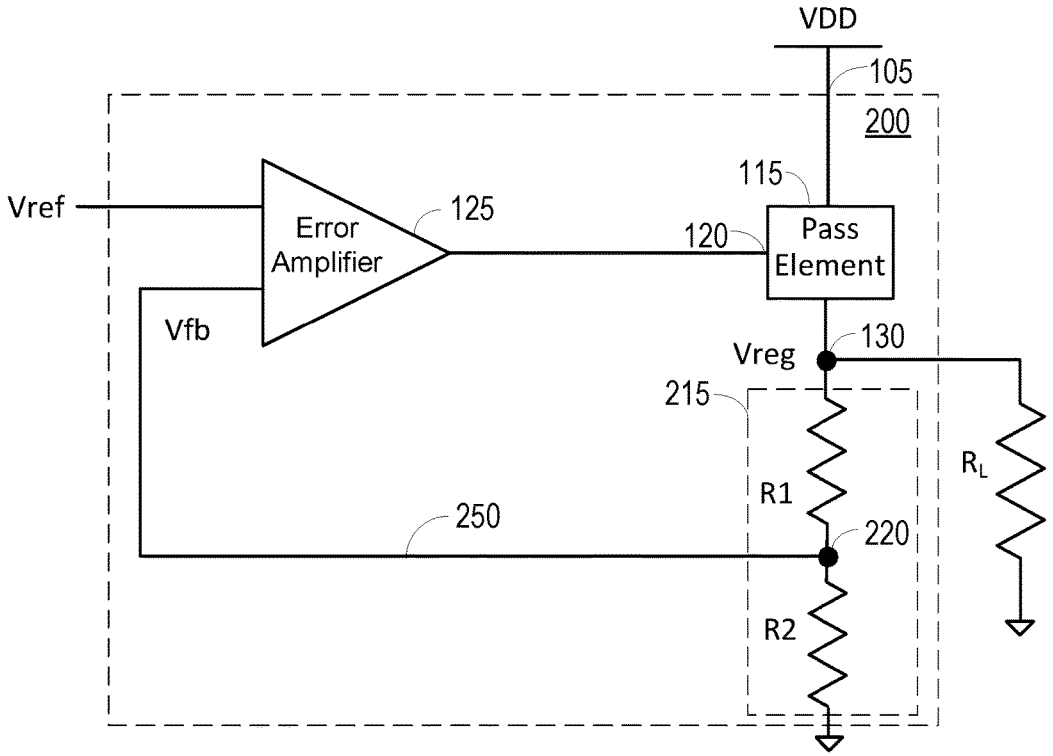
FIG. 2 shows an example of an LDO regulator including a voltage divider in a feedback path.

In the example in FIG. 1, the regulated voltage Vreg is fed directly to the error amplifier 125. However, it is to be appreciated that the present disclosure is not limited to this example. For example, FIG. 2 shows another example of a LDO regulator 200, in which the regulated voltage Vref is fed back to the error amplifier 125 through a voltage divider 215. The voltage divider 215 includes two series resistors R1 and R2 coupled to the output 130 of the LDO voltage regulator 200. The voltage at the node 220 between the resistors R1 and R2 is fed back to the amplifier 125. In this example, the feedback voltage Vfb is related to the regulated voltage Vreg as follows:

$$Vfb = \left(\frac{R2}{R1 + R2}\right) \cdot Vreg \tag{1}$$

where R1 and R2 in equation (1) are the resistances of resistors R1 and R2, respectively. Thus, in this example, the feedback voltage Vfb is proportional to the regulated voltage Vreg, in which the proportionality is set by the ratio of the resistances of resistors R1 and R2.

The error amplifier 125 drives the control input 120 of the pass element 115 in a direction that reduces the difference (error) between the feedback voltage Vfb and reference voltage Vref. This feedback causes the regulated voltage Vreg to be approximately equal to:

$$Vreg = \left(1 + \frac{R1}{R2}\right) \cdot Vref \tag{2}$$

As shown in equation (2), in this example, the regulated voltage may be set to a desired voltage by setting the ratio of the resistances of resistors R1 and R2 accordingly. Therefore, in the present disclosure, it is to be appreciated that the feedback voltage Vfb may be equal to or proportional to the regulated voltage Vreg.

The pass element 115 may be implemented with a p-type field effect transistor (PFET) or an n-type field effect transistor (NFET). The PFET or NFET may be fabricated using a planar processor, a FinFET process, and/or another fabrication process.

Figure 3:
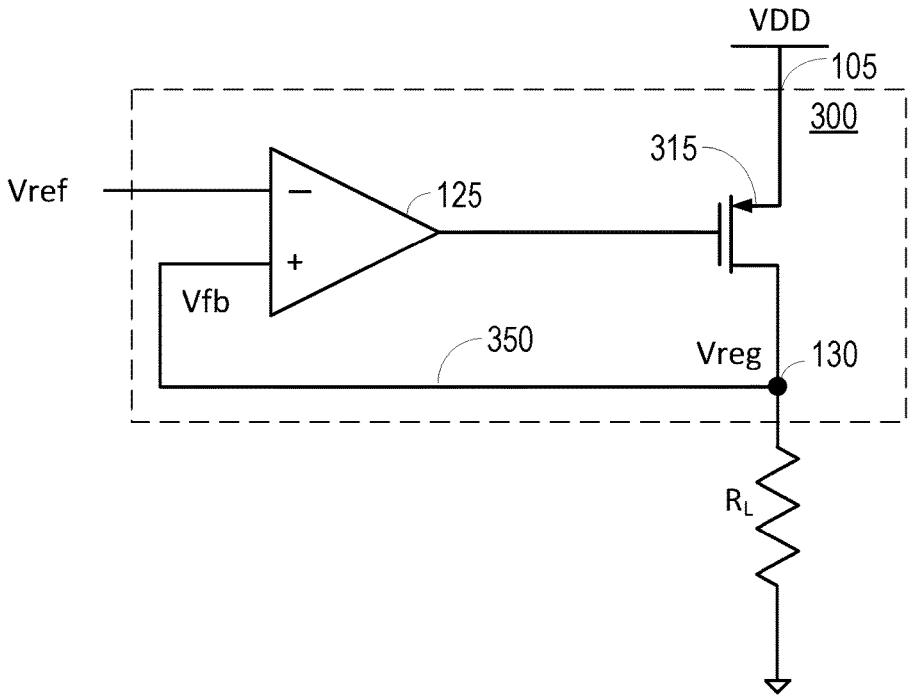
FIG. 3 shows an example of an LDO regulator including a p-type field effect transistor (PFET) as a pass element.

FIG. 3 shows an example in which the pass element of an LDO regulator 300 is implemented with a pass PFET 315. The PFET 315 has a source coupled to the input 105 of the LDO regulator 300, a gate coupled to the output of the error amplifier 125, and a drain coupled to the output 130 of the LDO regulator 300. The error amplifier 125 controls the resistance of the PFET 315 between the input 105 and the output 130 of the LDO regulator 300 by adjusting the gate voltage of the PFET 315. More particularly, the error amplifier 125 increases the resistance of the PFET 315 by increasing the gate voltage, and decreases the resistance of the PFET 315 by decreasing the gate voltage.

In this example, the reference voltage Vref is coupled to the minus input of the error amplifier 125. The regulated voltage Vreg at the output 130 is fed back to the plus input of the error amplifier 125 as feedback voltage Vfb via feedback path 350. During operation, the error amplifier 125 drives the gate of the pass PFET 315 in a direction that reduces the difference (error) between the reference voltage Vref and the feedback voltage Vfb. Since the feedback voltage Vfb is approximately equal to the regulated voltage Vreg in this example, the error amplifier 125 drives the gate of the pass PFET 315 in a direction that causes the regulated voltage Vreg to be approximately equal to the reference voltage Vref.

The pass PFET 315 allows the LDO regulator 300 to achieve a low voltage drop and good power efficiency. However, there are several disadvantages of using the pass PFET 315 as the pass element. One disadvantage is that the high impedance of the pass PFET 315 at the output 130 of the LDO regulator 300 may produce a low-frequency pole at the output 130. The low-frequency pole at the output 130 in combination with a low-frequency pole at the gate of the pass PFET 315 may cause excessive phase shifting in the feedback loop at relatively low frequency, leading to loop instability. For example, the excessive phase shifting may cause instability if the phase shifting approaches 180 degrees at a loop gain of zero dB or above. The phase shifting may be reduced by coupling a large compensation capacitor to the output 130. However, the large compensation capacitor takes up a large chip area. The phase shifting may also be reduced by pushing the pole at the gate to higher frequency. This may be achieved, for example, by reducing the output impedance of the error amplifier 125. However, this reduces the loop gain, which, in turn, degrades the power supply rejection ratio (PSRR) of the LDO regulator 300. The PSRR measures the ability of the LDO regulator to reject noise (e.g., ripple) on the power supply rail. Another disadvantage of using the pass PFET 315 as the pass element is that loop stability is dependent on the load coupled to the LDO regulator 300.

Figure 4:
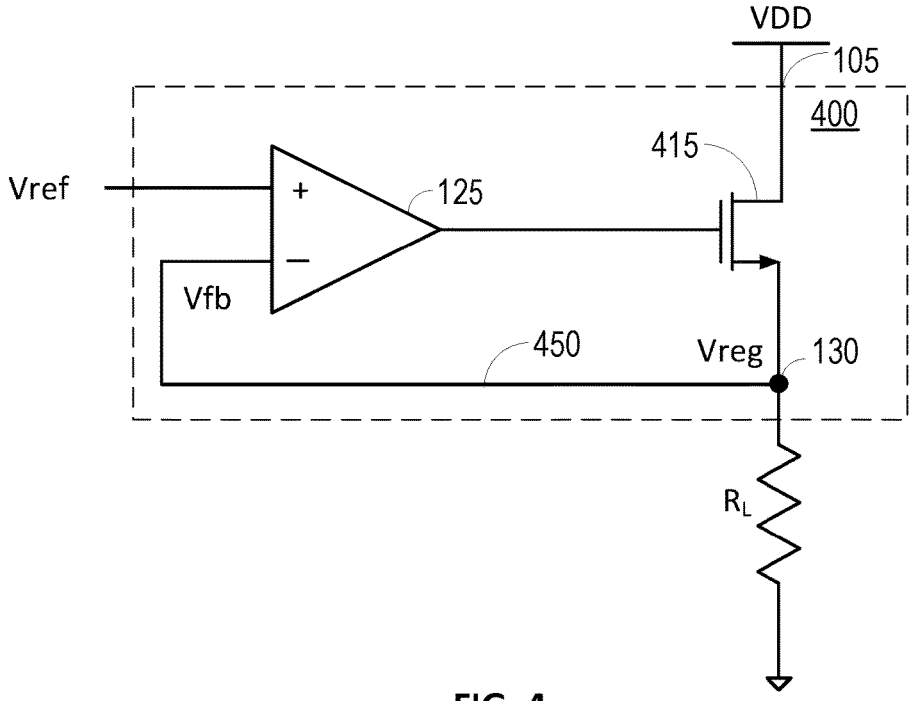
FIG. 4 shows an example of an LDO regulator including an n-type field effect transistor (NFET) as a pass element.

FIG. 4 shows an example in which the pass element of an LDO regulator 400 is implemented with a pass NFET 415. The NFET 415 has a drain coupled to the input 105 of the LDO regulator 400, a gate coupled to the output of the error amplifier 125, and a source coupled to the output 130 of the LDO regulator 400. The error amplifier 125 controls the resistance of the NFET 415 between the input 105 and the output 130 of the LDO regulator 400 by adjusting the gate voltage of the NFET 415. More particularly, the error amplifier 125 increases the resistance of the NFET 415 by decreasing the gate voltage, and decreases the resistance of the NFET 415 by increasing the gate voltage.

In this example, the reference voltage Vref is coupled to the plus input of the error amplifier 125. The regulated voltage Vreg at the output 130 is fed back to the minus input of the error amplifier 125 as feedback voltage Vfb via feedback path 450. During operation, the error amplifier 125 drives the gate of the pass NFET 415 in a direction that reduces the difference (error) between the reference voltage Vref and the feedback voltage Vfb. Since the feedback voltage Vfb is approximately equal to the regulated voltage Vreg in this example, the error amplifier 125 drives the gate of the pass NFET 415 in a direction that causes the regulated voltage Vreg to be approximately equal to the reference voltage Vref.

The pass NFET 415 provides several advantages over the pass PFET 315. One advantage is that the relatively low impedance of the NFET 415 at the output 130 of the LDO regulator 400 helps prevent a low-frequency pole from forming at the output 130. This may eliminate the need for a large compensation capacitor at the output 130. In addition, this may make the stability of the loop substantially independent of the load.

However, a problem with the NFET based LDO regulator 400 is that the regulated voltage Vreg at the output 130 of the LDO regulator 400 is lower than the gate voltage of the pass NFET 415 by the gate-to-source voltage of the NFET 415, which may exceed the threshold voltage of the NFET 415. As a result, the regulated voltage Vreg at the output 130 may be below the gate voltage of the pass NFET 415 by at least the threshold voltage of the pass NFET 415, making it difficult for the LDO regulator 400 to achieve a low voltage drop between VDD and Vreg for high efficiency.

One approach to address this problem is to use a native NFET for the pass element, in which the native NFET has an approximately zero threshold voltage. This significantly reduces the gate-to-source voltage of the NFET, allowing the LDO regulator to achieve a lower voltage drop between VDD and Vreg. However, a foundry may not provide native NFETs on a chip (e.g., for a standard process). As a result, a native NFET may not be available for use as a pass element for an LDO regulator on the chip.

Figure 5:
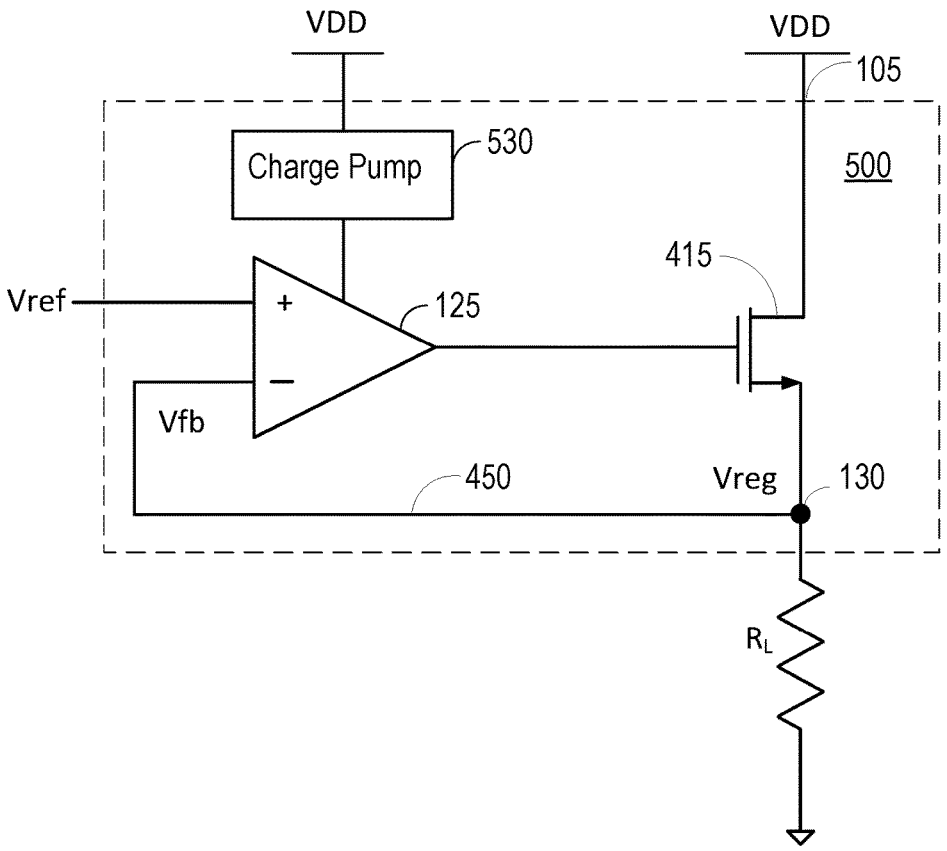
FIG. 5 shows an example of an NFET based LDO regulator including a charge pump to boost a supply voltage of an error amplifier.

Another approach is to boost the supply voltage of the error amplifier 125 using a charge pump. This approach is illustrated in FIG. 5, which shows an NFET based LDO regulator 500 including a charge pump 530 coupled between the power supply rail and the supply input of the error amplifier 125. The charge pump 530 boosts the supply voltage of the error amplifier 125 above VDD. The boosted supply voltage enables the error amplifier 125 to drive the gate of the pass NFET 415 above VDD. The higher gate voltage allows the LDO regulator 500 to set the regulated voltage Vreg closer to VDD, thereby reducing the voltage drop between VDD and Vreg.

However, a drawback of this approach is that the charge pump 530 may suffer from large ripples at the output of the charge pump 530. This is due to the fact that the charge pump 530 needs to source a relatively large amount of current to the error amplifier 125 in order for the error amplifier 125 to operate. The large ripples may propagate to the output 130 of the LDO regulator 500, resulting in large ripples in the regulated voltage Vreg.

Figure 6:
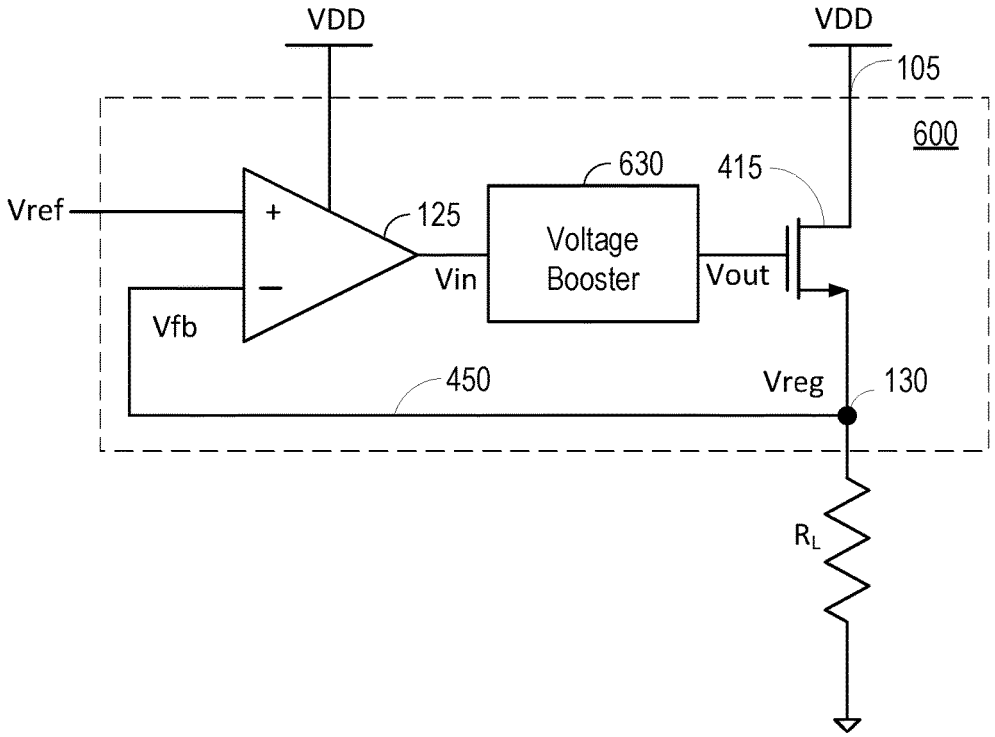
FIG. 6 shows an example of an NFET based LDO regulator including a voltage booster according to certain aspects of the present disclosure.

FIG. 6 shows an LDO regulator 600 according to certain aspects of the present disclosure. The LDO regulator 600 includes a voltage booster 630 coupled between the output of the error amplifier 125 and the gate of the pass NFET 415. The voltage booster 630 has an input coupled to the output of the error amplifier 125, and an output coupled to the gate of the pass NFET 415. The voltage booster 630 is configured to receive the output voltage of the amplifier 125 at the input of the voltage booster 630 (denoted "Vin"), to boost (increase) the output voltage of the amplifier 125 to generate a boosted voltage, and to output the boosted voltage at the output of the voltage booster 630 (denoted "Vout"). For example, the voltage booster 630 may double the voltage at the output of the error amplifier 125. The boosted voltage at the gate of the pass NFET 415 allows the LDO regulator 600 to set the regulated voltage Vreg closer to VDD, thereby reducing the voltage drop between VDD and Vreg for greater efficiency.

The LDO regulator 600 differs from the LDO voltage regulator 500 in FIG. 5 in that the voltage booster 630 boosts the output voltage of the error amplifier 125 while the charge pump 530 in FIG. 5 boosts the supply voltage to the error amplifier 125. The voltage booster 630 in FIG. 6 has much lower ripple than the charge pump 530 in FIG. 5. This is because the voltage booster 630 does not need to supply a relatively large amount of current to the error amplifier 125. Instead, the voltage booster 630 drives the gate of the pass NFET 415 with the boosted voltage, which requires little current.

In the example in FIG. 6, the regulated voltage Vreg is fed directly to the error amplifier 125 via feedback path 450. However, it is to be appreciated that the present disclosure is not limited to this example. For instance, a voltage divider (e.g., voltage divider 215) may be placed in the feedback path 450, in which case the feedback voltage Vfb is proportional to the regulated voltage Vreg, as discussed above.

Figure 7:
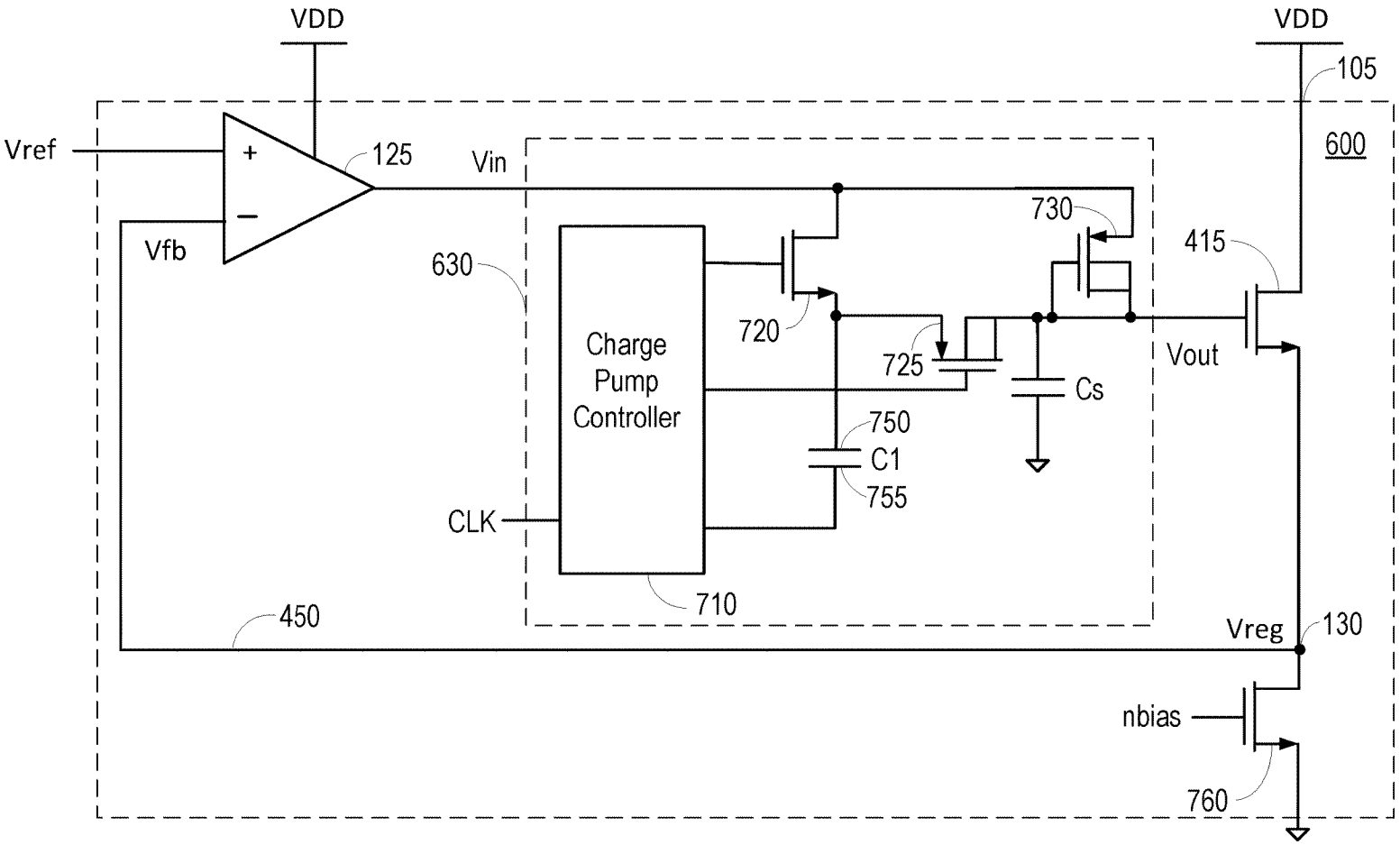
FIG. 7 shows an exemplary implementation of the voltage booster according to certain aspects of the present disclosure.

FIG. 7 shows an exemplary implementation of the voltage booster 630 according to certain aspects of the present disclosure. In this example, the voltage booster 630 includes a first switch 720, a first capacitor C1, a second switch 725, an output capacitor Cs, and a charge pump controller 710. The first switch 720 is coupled between the input of the voltage booster 630 and a first terminal 750 of the first capacitor C1, and the second switch 725 is coupled between the first terminal 750 of the first capacitor C1 and the output of the voltage booster 630. The charge pump controller 710 is coupled to a second terminal 755 of the first capacitor C1. The output capacitor Cs is coupled between the output of the voltage booster 630 and ground.

In the example in FIG. 7, the first switch 720 is implemented with an NFET having a drain coupled to the input of the voltage booster 630, a gate coupled to the charge pump controller 710, and a source coupled to the first terminal 750 of the first capacitor C1. As discussed further below, the charge pump controller 710 selectively opens and closes the first switch 720 by changing the gate voltage of the first switch 720. The second switch 725 is implemented with a PFET having a drain coupled to the output of the voltage booster 630, a gate coupled to the charge pump controller 710, and a source coupled to the first terminal 750 of the first capacitor C1. As discussed further below, the charge pump controller 710 selectively opens and closes the second switch 725 by changing the gate voltage of the second switch 725.

The charge pump controller 710 receives a clock signal (denoted "CLK"), and times operations of the charge pump controller 710 based on the clock signal CLK. The clock signal CLK may come from an oscillator, a phase locked loop (PLL), and/or other clock source. During each cycle (period) of the clock signal CLK, the charge pump controller 710 may perform the operations described below with reference to FIG. 8.

During a first portion 815 of a clock cycle 810, the charge pump controller 710 couples the output of the error amplifier 125 to the first terminal 750 of the first capacitor C1 by closing the first switch 720, and applies a low voltage (e.g., approximately zero volts) to the second terminal 755 of the first capacitor C1. This allows the output of the error amplifier 125 to charge the first capacitor C1 to approximately Vin. During this time, the charge pump controller 710 may open the second switch 725 to decouple the first capacitor C1 from the output of the voltage booster 630 while the first capacitor C1 is charging. For the example in which the first switch 720 is implemented with an NFET, the charge pump controller 710 may close the first switch 720 by applying a voltage greater than Vin to the gate of the first switch 720, as discussed further below.

Figure 8:
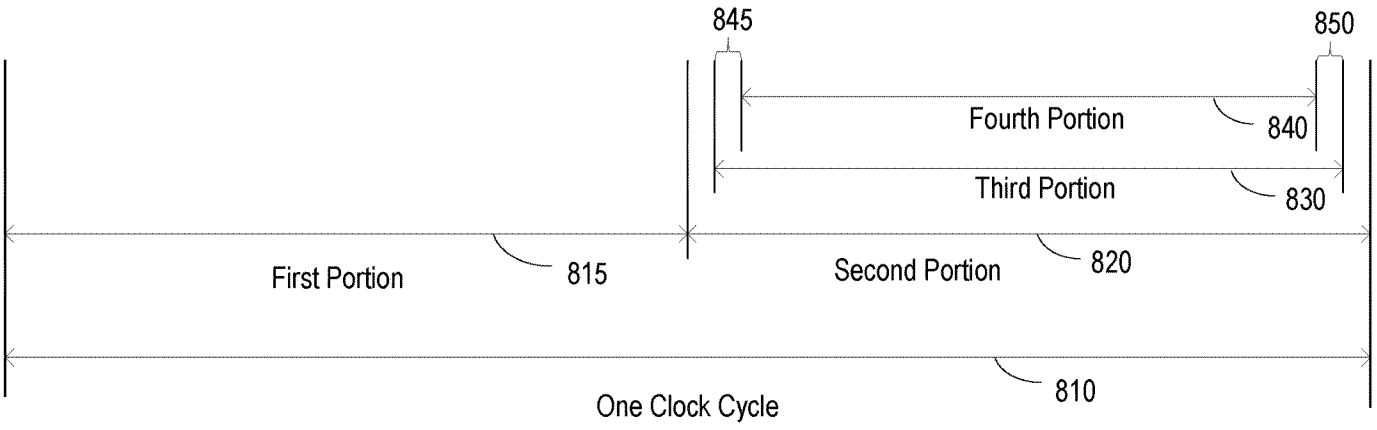
FIG. 8 shows an example of a timeline for operations of the voltage booster during one clock cycle according to certain aspects of the present disclosure

During a second portion 820 of the clock cycle 810, the charge pump controller 710 decouples the first terminal 750 of the first capacitor C1 from the output of the error amplifier 125 by opening the first switch 720. The first and second portions of the clock cycle are non-overlapping, as shown in FIG. 8.

During a third portion 830 of the clock cycle 810, the charge pump controller 710 applies a boosting voltage to the second terminal 755 of the first capacitor C1, which boosts the voltage at the first terminal 750 of the first capacitor C1. The third portion 830 of the clock cycle 810 is within the second portion 820 of the clock cycle 810 so that the first terminal 750 of the first capacitor C1 is decoupled from the output of the error amplifier 125 during the time that the voltage of the first capacitor C1 is boosted. The voltage at the first terminal 750 of the first capacitor C1 may be boosted to a voltage approximately equal to:

$$V_{Boost}=V\text{in}+V_{Boosting_Voltage} \tag{3}$$

where $V_{Boost}$ is the boosted voltage at the first terminal 750 of the first capacitor C1, Vin is the input voltage to the voltage booster 630 (which is approximately equal to the output voltage of the error amplifier 125), and $V_{Boosting_Voltage}$ is the boosting voltage applied to the second terminal 755 of the first capacitor C1. For example, if the boosting voltage applied to the second terminal 755 is approximately equal to Vin, then the first terminal 750 of the first capacitor C1 is boosted to a voltage approximately equal to 2*Vin. Thus, in this example, the boosted voltage is approximately double the input voltage Vin to the voltage booster 630 (i.e., approximately double the output voltage of the error amplifier 125). In this case, the voltage booster 630 acts as a voltage doubler.

During a fourth portion 840 of the clock cycle 810, the charge pump controller 710 couples the first terminal 750 of the first capacitor C1 to the output of the voltage booster 630 by closing the second switch 725. This allows charge to transfer from the first capacitor C1 to the output capacitor Cs, which stores the charge at the output of the voltage booster 630 at approximately the boosted voltage. The fourth portion 840 of the clock cycle 810 is within the third portion 830 of the clock cycle 810 so that the first terminal 750 of the first capacitor C1 is coupled to the output of the voltage booster 630 during the time that the voltage of the first capacitor C1 is boosted. For the example in which the second switch 725 is implemented with an PFET, the charge pump controller 710 may close the second switch 725 by applying a voltage below the boosted voltage to the gate of the second switch 725, as discussed further below.

In the example in FIG. 8, the fourth portion 840 of the clock cycle 810 is shorter than the third portion 830 of the clock cycle 810 with a space 845 between the beginnings of the third and fourth portions of the clock cycle and a space 850 between the ends of the third and fourth portions clock cycle. This may be done to help ensure that the voltage of the first capacitor C1 is boosted when the second switch 725 is turned on (closed) to prevent leakage current flow from the output capacitor Cs to the first capacitor C1 through the second switch 725.

Thus, the charge pump controller 710 alternates between charging the first capacitor C1 by coupling the first terminal 750 of the first capacitor C1 to the output of the error amplifier 125 and boosting the voltage of the first capacitor C1 by applying the boosting voltage to the second terminal 755 of the first capacitor C1. The rate at which the charge pump controller 710 alternates between charging the first capacitor C1 and boosting the voltage of the first capacitor C1 is determined by the frequency of the clock signal CLK. In certain aspects, the frequency of the clock signal CLK may vary over a wide frequency range (e.g., between 20 MHz and 100 MHz). Each time the voltage of the first capacitor C1 is boosted, the charge pump controller 710 closes the second switch 725 to transfer charge from the first capacitor C1 to the output capacitor Cs, which stores the charge at approximately the boosted voltage. This allows the output of the voltage booster 630 to maintain the boosted voltage at the output of the voltage booster 630 during the times that the first capacitor C1 is being charged. In certain aspects, the output capacitor Cs may be omitted. In these aspects, the gate capacitor of the pass NFET 415 may store charge from the first capacitor C1.

In certain aspects, the voltage booster 630 may include a diode-connected transistor 730 coupled between the input and output of the voltage booster 630, an example of which is shown in FIG. 7. The diode-connected transistor 730 provides faster start-up of the voltage booster 630 by charging the output capacitor Cs when the voltage booster 630 is initially turned on. More particularly, when the voltage booster 630 is initially turned on, the diode-connected transistor 730 is forward biased and provides a charging path (conducting path) between the output of the error amplifier 125 and the output capacitor Cs (assuming Vin is initially greater than Vout). The charging path allows the output of the error amplifier 125 to quickly charge the output capacitor Cs through the diode-connected transistor 730.

During normal operation, the diode-connected transistor 730 is reversed biased. This is because, during normal operation, the boosted voltage at the output of the voltage booster 630 is greater than the output voltage of the error amplifier 125. As a result, the diode-connected transistor 730 does not conduct charge during normal operation. Thus, the diode-connected transistor 730 is initially forward biased to provide a charging path from the output of the error amplifier 125 to the output capacitor Cs for faster start-up, and reversed biased during normal operation. In the example in FIG. 7, the diode-connected transistor 730 is implemented with a PFET having a source coupled to the output of the error amplifier 125, and a gate and a drain tied together at the output of the voltage booster 630.

In the example in FIG. 7, the LDO regulator 600 includes a NFET 760 coupled between the output 130 of the LDO regulator 600 and ground. More particularly, the NFET 760 has a drain coupled to the output 130, a gate biased by a bias voltage (denoted "nbias"), and a source coupled to ground. The bias voltage turns on the NFET 760 so that the NFET 760 draws a small amount of current from the output 130. The small amount of current may be approximately equal to a minimum amount of current needed for the LDO regulator 600 to maintain voltage regulation. This allows the LDO regulator 600 to maintain voltage regulation when the LDO regulator 600 is not sourcing enough current to a load (not shown in FIG. 7) to maintain regulation.

Figure 9:
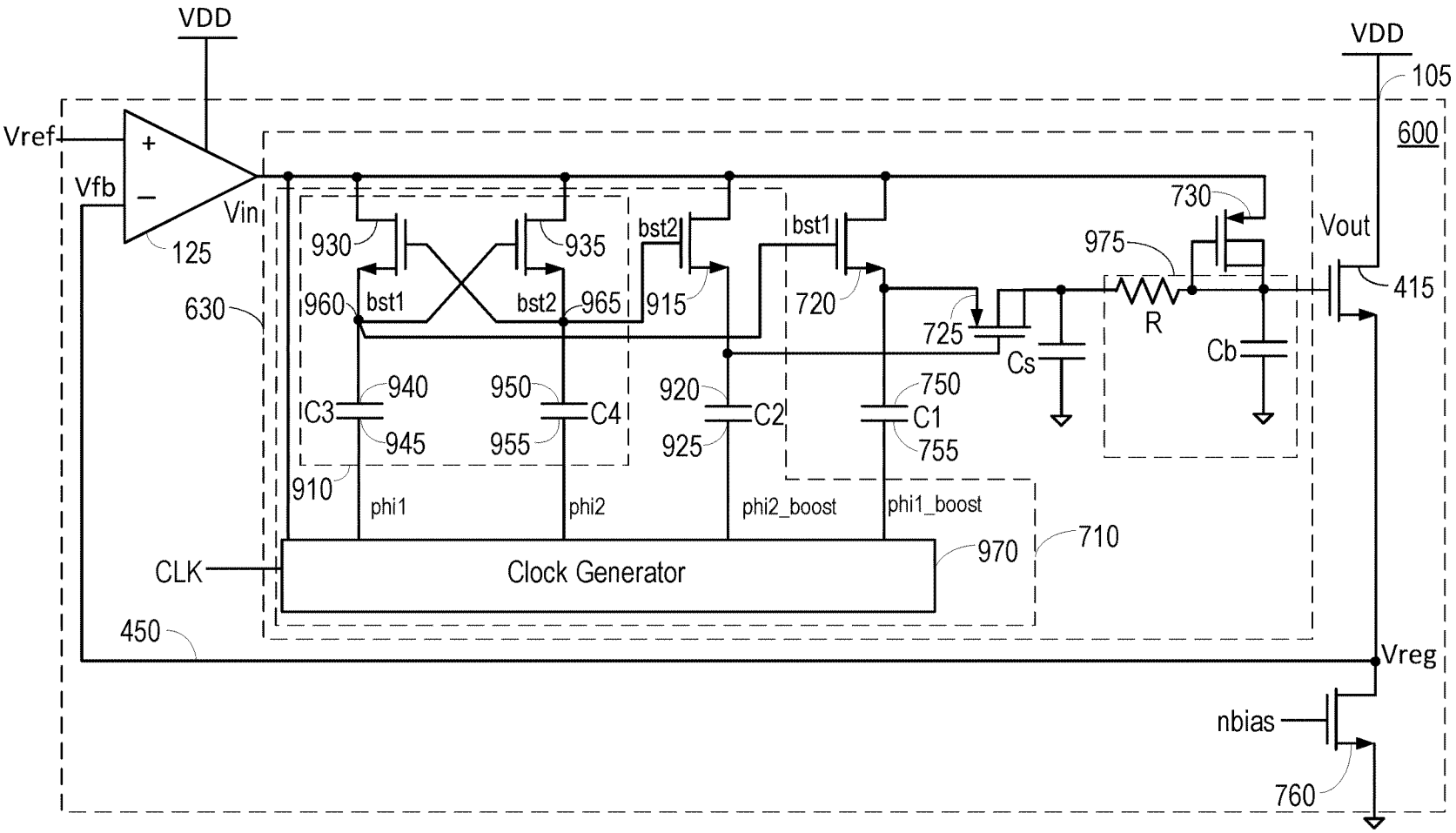
FIG. 9 shows another exemplary implementation of the voltage booster according to certain aspects of the present disclosure.

FIG. 9 shows an exemplary implementation of the charge pump controller 710 according to certain aspects of the present disclosure. In this example, the charge pump controller 710 includes a third switch 915, a second capacitor C2, a control signal generator 910, and a clock generator 970. The third switch 915 is coupled between the output of the error amplifier 125 and a first terminal 920 of the second capacitor C2. The first terminal 920 of the second capacitor C2 is also coupled to the gate of the second switch 725, which is implemented with a PFET in this example. The clock generator 970 is coupled to the second terminal 755 of the first capacitor C1, and to a second terminal 925 of the second capacitor C2.

Figure 10:
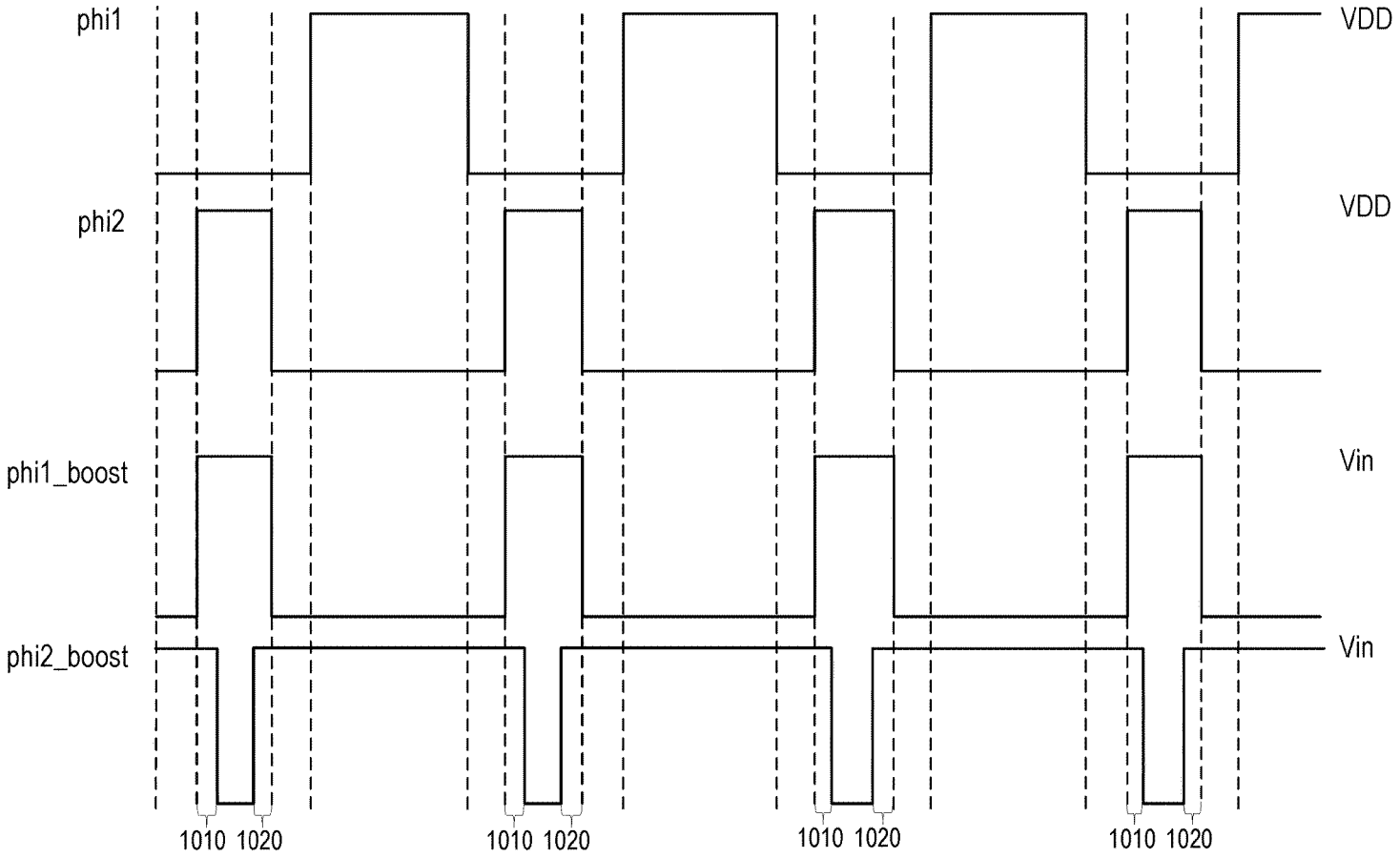
FIG. 10 shows an example of a timeline for exemplary signals in the voltage booster according to certain aspects of the present disclosure.

The clock generator 970 is configured to generate and output boosting signal phi1_boost to the second terminal 755 of the first capacitor C1, and generate and output boosting signal phi2_boost to the second terminal 925 of the second capacitor C2. FIG. 10 shows an exemplary timeline of boosting signals phi1_boost and phi2_boost over several clock cycles, in which boosting signals phi1_boost and phi2_boost each have a voltage swing approximately equal to the input voltage Vin to the voltage booster 630.

The control signal generator 910 is configured to generate and output gate control signals for the first switch 720 and the third switch 915. More particularly, the control signal generator 910 is configured to generate and output gate control signal bst1 to the gate of the first switch 720, which is implemented with an NFET in this example. The control signal generator 910 is also configured to generate and output gate control signal bst2 to the gate of the third switch 915, which is implemented with an NFET in this example. During operation, the gate control signals bst1 and bst2 alternately turn on the second switch 720 and third switch 915, respectively.

When gate control signal bst1 turns on (closes) the first switch 720, the first terminal 750 of the first capacitor C1 is coupled to the output of the error amplifier 125, and is therefore charged to approximately Vin. During this time, boosting signal phi1_boost may be at a low voltage (e.g., approximately zero volts).

When gate control signal bst1 turns off (opens) the first switch 720, boosting signal phi1_boost may rise to a voltage of Vin. This boosts the voltage at the first terminal 750 of the first capacitor C1 to approximately 2*Vin (i.e., doubles the input voltage of the voltage booster 630). The second switch 725 may also be turned on during this time by lowering the gate voltage of the second switch 725, as discussed further below. This allows charge to transfer from the first capacitor C1 to the output capacitor Cs at approximately the boosted voltage.

Thus, when gate control signal bst1 turns on the first switch 720, the first capacitor C1 is charged to approximately Vin, and, when gate control signal bst1 turns off the first switch 720, the voltage at the first terminal 750 of the first capacitor C1 is boosted to approximately 2*Vin.

When gate control signal bst2 turns on (closes) the third switch 915, the first terminal 920 of the second capacitor C2 is coupled to the output of the error amplifier 125, and is therefore charged to approximately Vin. During this time, boosting signal phi2_boost may be at a low voltage (e.g., approximately zero volts). Also, during this time, the voltage at the first terminal 750 of the first capacitor C1 may be boosted to approximately 2*Vin, as discussed above. Since the voltage at the first terminal 920 of the second capacitor C2 is coupled to the gate of the second switch 725 and is lower than the boosted voltage by at least Vin, the second switch 725 is turned on. This allows charge to transfer from the first capacitor C1 to the output capacitor Cs, as discussed above.

When gate control signal bst2 turns off the third switch 925, the voltage of boosting signal phi2_boost may rise to Vin. This boosts the voltage at the first terminal 920 of the second capacitor C2 to approximately 2*Vin. Since the voltage at the first terminal 920 of the second capacitor C2 is coupled to the gate of the second switch 725 and is equal to the boosted voltage, the second switch 725 is turned off. This may occur during the time that the first capacitor C1 is being charged, as discussed above.

Thus, the voltage at the first terminal 920 of the second capacitor C2 controls whether the second switch 725 is turned on or off. When the second capacitor C2 is being charged, the second switch 725 is turned on, and, when the voltage at the first terminal 920 of the second capacitor C2 is boosted, the second switch 725 is turned off. The boosted voltage at the first terminal 920 of the second capacitor C2 provides a voltage at the gate of the second switch 725 that is high enough to turn off the second switch 725, which is implemented with a PFET in this example.

As discussed above, the voltage at the first terminal 750 of the first capacitor C1 is boosted to approximately 2*Vin when the voltage of boosting signal phi1_boost goes to Vin.

During this time, the voltage of boosting signal phi2_boost goes low (e.g., approximately zero volts) to charge the second capacitor C2 and turn on the second switch 725. In the example in FIG. 10, there is a delay 1010 between the time that the voltage of boosting signal phi1_boost goes to Vin and the time that the voltage of boosting signal phi2_boost goes low. The delay 1010 helps ensure that the voltage at the first terminal 750 of the first capacitor C1 is boosted before the second switch 725 is turned on. This helps prevent leakage current flow from the output capacitor Cs to the first capacitor C1, which may occur if the second switch 725 is prematurely turned on before the voltage at the first terminal 750 of the first capacitor C1 is boosted. Minimizing leakage current is important because leakage current may result in ripples at the output of the voltage booster 630.

In the example in FIG. 10, there is also a delay 1020 between the time that the voltage of boosting signal phi2_boost goes back to Vin and the time that the voltage of boosting signal phi1_boost goes low. The delay 1020 helps ensure that the voltage at the first terminal 750 of the first capacitor C1 is still boosted when the second switch 725 is turned off.

As discussed above, the control signal generator 910 generates gate control signals bst1 and bst2 for controlling the first and third switches 720 and 915, respectively. In the example shown in FIG. 9, the control signal generator 910 includes a first NFET 930, a second NFET 935, a third capacitor C3, and a fourth capacitor C4. The drains of the first and second NFETs 930 and 935 are coupled to the input of the voltage booster 630. The first and second NFETs 930 and 935 are cross-coupled in which the gate of the first NFET 930 is coupled to the source of the second NFET 935, and the gate of the second NFET 935 is coupled to the source of the first NFET 930. A first terminal 940 of the third capacitor C3 is coupled to the source of the first NFET 930, and a first terminal 950 of the fourth capacitor C4 is coupled to the source of the second NFET 935. The clock generator 970 is coupled to a second terminal 945 of the third capacitor C3, and to a second terminal 955 of the fourth capacitor C4.

The clock generator 970 is configured to output signal phi1 to the second terminal 945 of the third capacitor C3, and output signal phi2 to the second terminal 955 of the fourth capacitor C4. FIG. 10 shows an exemplary timeline of signals phi1 and phi2 over several clock cycles, in which signals phi1 and phi2 each have a voltage swing approximately equal to the supply voltage VDD.

Gate control signal bst1 is taken at node 960 between the source of the first NFET 930 and the first terminal 940 of the third capacitor C3, and gate control signal bst2 is taken at node 965 between the source of the second NFET 935 and the first terminal 950 of the fourth capacitor C4, as shown in FIG. 9.

During operation, the voltages of signals phi1 and phi2 alternately go to VDD. When the voltage of phi1 is VDD and the voltage of phi2 is low (e.g., approximately zero volts), the first NFET 930 is turned off and the second NFET 935 is turned on. The voltage at the first terminal 940 of the third capacitor C3 (and hence the voltage of gate control signal bst1) is boosted to a voltage approximately equal to the sum of Vin and VDD. As a result, the first switch 720 is turned on. The boosted voltage at the first terminal 940 of the third capacitor C3 (which is also coupled to the gate of the second NEFT 935) turns on the second NFET 935. As a result, the fourth capacitor C4 is charged by the output of the error amplifier 125 through the second NFET 935. During charging, the voltage of the first terminal 950 of the fourth capacitor C4 (and hence the voltage of gate control signal bst2) does not exceed Vin. As a result, the third switch 915 is turned off.

When the voltage of phi1 is low (e.g., approximately zero volts) and the voltage of phi2 is VDD, the first NFET 930 is turned on and the second NFET 935 is turned off. The voltage at the first terminal 950 of the fourth capacitor C4 (and hence the voltage of gate control signal bst2) is boosted to a voltage approximately equal to the sum of Vin and VDD. As a result, the third switch 915 is turned on. The boosted voltage at the first terminal 950 of the fourth capacitor C4 (which is also coupled to the gate of the first NFET 930) also turns on the first NFET 930. As a result, the third capacitor C3 is charged by the output of the error amplifier 125 through the first NFET 930. During charging, the voltage of the first terminal 940 of the third capacitor C3 (and hence the voltage of gate control signal bst1) does not exceed Vin. As a result, the first switch 720 is turned off.

In the example in FIG. 9, the voltage booster 630 also includes an RC circuit 975 coupled to the output of the voltage booster 630. The RC circuit 975 may include a resistor R and a capacitor Cb, as shown in FIG. 9. The RC circuit 975 may form a low-pass RC filter to filter out high frequency ripples from the output of the voltage booster 630. The RC circuit 975 may also be used to adjust the pole at the gate of the pass NFET 415 for gate compensation. For example, the pole at the gate of the pass NFET 415 may be adjusted by adjusting the capacitance of capacitor Cb and/or the resistance of resistor R.

Figure 11:
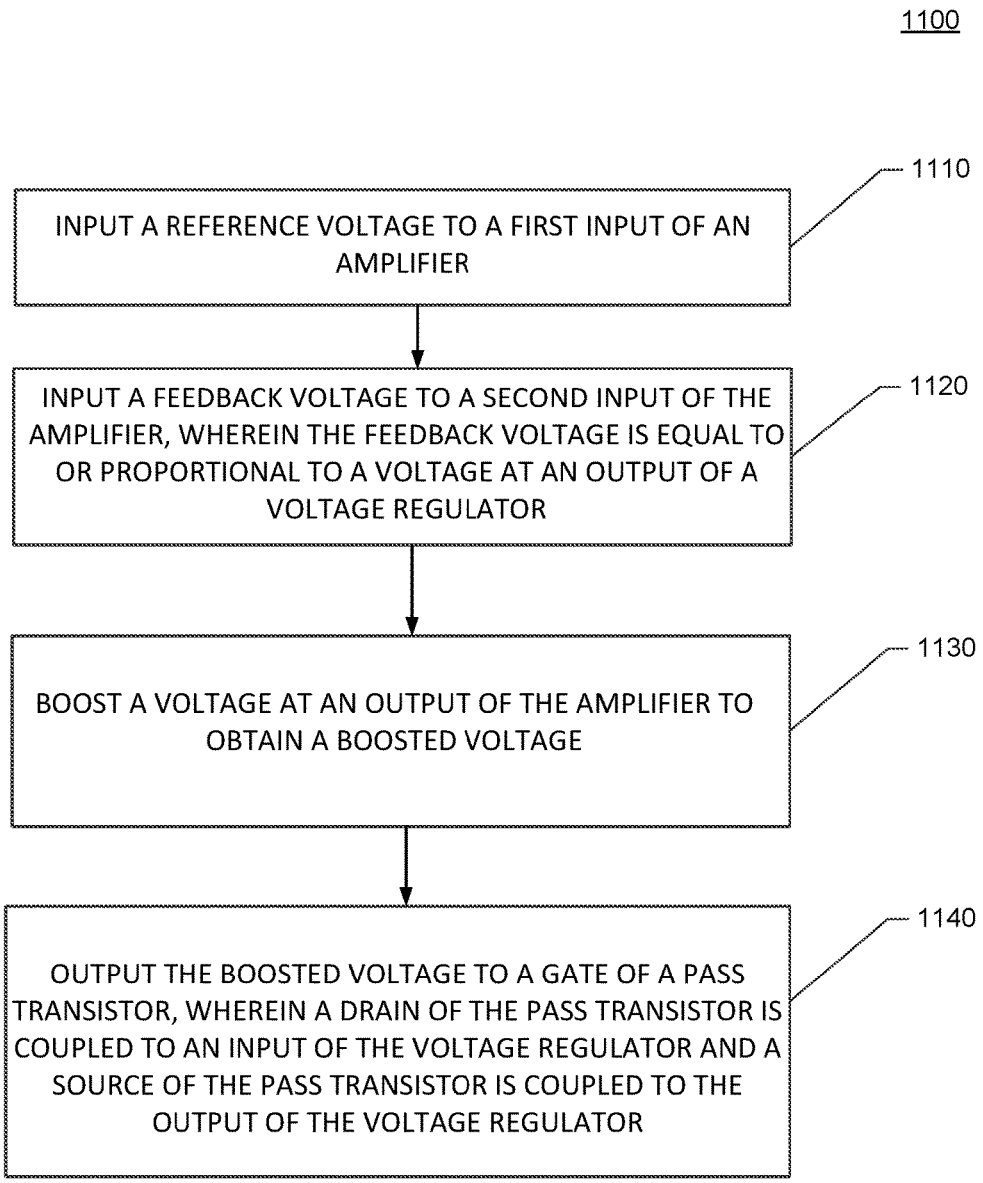
FIG. 11 is a flowchart showing a method for voltage regulation according to certain aspects of the present disclosure.

FIG. 11 is a flowchart illustrating a method 1100 for voltage regulation according to certain aspects of the present disclosure. The method 1100 may be performed by an NFET based LDO regulator (e.g., LDO regulator 600).

In step 1110, a reference voltage is input to a first input of an amplifier. For example, the reference voltage (e.g., Vreg) may be input to a plus input of the amplifier (e.g., error amplifier 125).

In step 1120, a feedback voltage is input to a second input of the amplifier, wherein the feedback voltage is approximately equal to or proportional to a voltage at an output of a voltage regulator. For example, the feedback voltage (e.g., Vfb) may be input to a minus input of the amplifier (e.g., error amplifier 125). The feedback voltage may be obtained by directly feeding back the output voltage of the voltage regulator to the amplifier or feeding back the output voltage of the voltage regulator to the amplifier via a voltage divider (e.g., voltage divider 215).

In step 1130, a voltage at an output of the amplifier is boosted to obtain a boosted voltage. For example, the output voltage of the amplifier may be boosted using a voltage booster (e.g., voltage booster 630).

In step 1140, the boosted voltage is outputted to a gate of a pass transistor, wherein a drain of the pass transistor is coupled to an input of the voltage regulator and a source of the voltage regulator is coupled to the output of the voltage regulator. For example, the pass transistor may be implemented with an NFET (e.g., pass NFET 415).

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples described herein but is to be accorded the widest scope consistent with the principles and novel features disclosed herein.

What is claimed is:

1. A voltage regulator, comprising:

a pass transistor having a drain coupled to an input of the voltage regulator, a source coupled to an output of the voltage regulator, and a gate;

an amplifier having a first input coupled to a reference voltage, a second input coupled to a feedback voltage, and an output, wherein the feedback voltage is approximately equal to or proportional to a voltage at the output of the voltage regulator; and a voltage booster having an input coupled to the output of the amplifier and an output coupled to the gate of the pass transistor, wherein the voltage booster is configured to boost a voltage at the input of the voltage booster to generate a boosted voltage, and to output the boosted voltage at the output of the voltage booster, and wherein the voltage booster comprises:

a capacitor having a first terminal and a second terminal;

a first switch coupled between the input of the voltage booster and the first terminal of the capacitor;

a second switch coupled between the first terminal of the capacitor and the output of the voltage booster; and a charge pump controller configured to close the first switch during a first portion of a clock cycle, to apply a boosting voltage to the second terminal of the first capacitor during a second portion of the clock cycle, and to close the second switch during a third portion of the clock cycle.

2. The voltage regulator of claim 1, wherein the charge pump controller is configured to open the first switch during the second portion of the clock cycle.

3. The voltage regulator of claim 1, wherein the third portion of the clock cycle is shorter than the second portion of the clock cycle and is within the second portion of the clock cycle.

4. The voltage regulator of claim 1, wherein the boosting voltage is approximately equal to the voltage at the input of the voltage booster.

5. The voltage regulator of claim 1, wherein the first switch comprises an n-type field effect transistor (NFET) having a drain coupled to the input of the voltage booster, a source coupled to the first terminal of the capacitor, and a gate coupled to the charge pump controller, and wherein the charge pump controller is configured to close the first switch by applying a voltage to the gate of the first switch that is greater than the voltage at the input of the voltage booster.

6. The voltage regulator of claim 1, wherein the charge pump controller is configured to open the second switch during the first portion of the clock cycle.

7. The voltage regulator of claim 6, wherein the second switch comprises a p-type field effect transistor (PFET) having a drain coupled to the output of the voltage booster, a source coupled to the first terminal of the capacitor, and a gate coupled to the charge pump controller, and wherein the charge pump controller is configured to open the second switch by applying a voltage to the gate of the second switch that is greater than the voltage at the input of the voltage booster.

8. The voltage regulator of claim 1, wherein the voltage booster further comprises a diode-connected transistor coupled between the input of the voltage booster and the output of the voltage booster.

9. The voltage regulator of claim 8, wherein the voltage booster further comprises an output capacitor coupled between the output of the voltage booster and a ground.

10. A method for voltage regulation, comprising:

inputting a reference voltage to a first input of an amplifier;

inputting a feedback voltage to a second input of the amplifier, wherein the feedback voltage is approximately equal to or proportional to a voltage at an output of a voltage regulator;

boosting a voltage at an output of the amplifier to obtain a boosted voltage; and outputting the boosted voltage to a gate of a pass transistor, wherein a drain of the pass transistor is coupled to an input of the voltage regulator and a source of the voltage regulator is coupled to the output of the voltage regulator;

wherein boosting the voltage at the output of the amplifier comprises:

coupling a first terminal of a capacitor to the output of the amplifier to charge the capacitor;

decoupling the first terminal of the capacitor from the output of the amplifier; and applying a boosting voltage to a second terminal of the capacitor after the first terminal of the capacitor is decoupled from the output of the amplifier to obtain the boosted voltage at the first terminal of the capacitor;

wherein outputting the boosted voltage to the gate of the pass transistor comprises coupling the first terminal of the capacitor to the gate of the pass transistor during a time that the boosting voltage is applied to the second terminal of the capacitor.

11. The method of 10, wherein the boosting voltage is approximately equal to a voltage at the output of the amplifier.

12. The method of claim 10, wherein a switch is between the output of the amplifier and the first terminal of the capacitor, and coupling the first terminal of the capacitor to the output of the amplifier comprises applying a voltage that is greater than the voltage at the output of the amplifier to a gate of the switch.

13. The method of claim 12, wherein decoupling the first terminal of the capacitor from the output of the capacitor comprises applying a voltage that is no greater than the voltage at the output of the amplifier to the gate of the switch.

14. The method of claim 10, wherein a switch is between the first terminal of the capacitor and the gate of the pass transistor, and coupling the first terminal of the capacitor to the gate of the pass transistor comprises applying a voltage that is lower than the boosted voltage to a gate of the switch.

15. An apparatus for voltage regulation, comprising:

means for generating a voltage based on a difference between a reference voltage and a feedback voltage, wherein the feedback voltage is approximately equal to or proportional to a voltage at an output of the apparatus;

means for boosting the generated voltage to obtain a boosted voltage; and means for adjusting a resistance of a pass element in response to the boosted voltage in order to maintain an approximately constant regulated voltage at the output of the apparatus;

wherein the means for boosting the generated voltage comprises:

means for coupling a first terminal of a capacitor to the means for generating the voltage to charge the capacitor to approximately the generated voltage;

means for decoupling the first terminal of the capacitor from the means for generating the voltage after the capacitor is charged; and means for applying a boosting voltage to a second terminal of the capacitor after the first terminal of the capacitor is decoupled from the means for generating the voltage to obtain the boosted voltage; and wherein the means for adjusting the resistance of the pass element comprises means for coupling the first terminal of the capacitor to a gate of the pass element during a time that the boosting voltage is applied to the second terminal of the capacitor.

16. The apparatus of claim 15, wherein the boosting voltage is approximately equal to the generated voltage.

* * * * *